US008429836B1

(12) United States Patent
Tomor

(10) Patent No.: US 8,429,836 B1
(45) Date of Patent: Apr. 30, 2013

(54) COLLAPSIBLE ATHLETIC SHOE

(76) Inventor: Veronica Tomor, Hollywood, FL (US)

( * ) Notice: Subject to any disclaimer, the term of this patent is extended or adjusted under 35 U.S.C. 154(b) by 521 days.

(21) Appl. No.: 12/701,257

(22) Filed: Feb. 5, 2010

(51) Int. Cl.

| | |
|---|---|
| ***A43B 3/24*** | (2006.01) |
| ***A43B 5/10*** | (2006.01) |
| ***A43B 21/24*** | (2006.01) |
| ***A43B 21/42*** | (2006.01) |

(52) U.S. Cl.
USPC ..... 36/100; 36/50.1; 36/88; 36/105; 36/114

(58) Field of Classification Search ..... 36/8.1, 36/51, 58.6, 68, 69, 88, 100, 102, 105, 106, 36/50.1
See application file for complete search history.

(56) References Cited

U.S. PATENT DOCUMENTS

| | | | | |
|---|---|---|---|---|
| 1,769,328 | A * | 7/1930 | Auster | 36/11.5 |
| 2,451,372 | A * | 10/1948 | Ballenger | 36/11.5 |
| 3,336,683 | A * | 8/1967 | Schellkopf | 36/11.5 |
| D304,128 | S | 10/1989 | Kolman et al. | |
| 4,967,750 | A * | 11/1990 | Cherniak | 36/140 |
| D321,084 | S * | 10/1991 | Miller et al. | D2/903 |
| 5,086,576 | A | 2/1992 | Lamson | |
| 5,956,868 | A | 9/1999 | Stevens et al. | |
| 5,960,565 | A * | 10/1999 | Lochbaum | 36/8.1 |
| 6,298,583 | B1 | 10/2001 | Allen | |
| 6,477,793 | B1 | 11/2002 | Pruitt et al. | |
| 7,010,872 | B2 | 3/2006 | Pawlus et al. | |
| 7,168,190 | B1 | 1/2007 | Gillespie | |
| D582,134 | S * | 12/2008 | Von Conta et al. | D2/903 |
| 7,930,841 | B2 * | 4/2011 | Luedecke et al. | 36/113 |
| 8,020,320 | B2 * | 9/2011 | Gillespie | 36/102 |
| 2002/0129519 | A1 | 9/2002 | Cahan | |
| 2004/0128863 | A1 | 7/2004 | Hong et al. | |
| 2008/0110059 | A1 * | 5/2008 | Kuramoto et al. | 36/114 |

* cited by examiner

*Primary Examiner* — Khoa Huynh
*Assistant Examiner* — Tiffany Drake

(57) ABSTRACT

A collapsible athletic shoe featuring an athletic shoe having a foot portion with an inner cavity, the foot portion can move between an extended position and a collapsed position; a first strap extending out of a first side of the sole area of the athletic shoe and a second strap extending out of a second side of the sole area of the athletic shoe, wherein the first and second straps function to secure the foot portion of the athletic shoe in the collapsed position, the first and second straps can be temporarily secured together via a first attachment means; and a heel strap disposed on the heel portion of the shoe, the heel strap functions to further secure the foot portion of the athletic shoe in the collapsed position.

3 Claims, 4 Drawing Sheets

100

COLLAPSIBLE ATHLETIC SHOE

FIELD OF THE INVENTION

The present invention is directed to footwear and shoes, more particularly to an athletic shoe that is collapsible to ensure continuity of a workout routine for the frequent traveler and easy transport in luggage.

BACKGROUND OF THE INVENTION

Space in suitcases can be very limited, and shoes often take up a great deal of the available space. The present invention features a collapsible athletic shoe that can be compacted so as to minimize space required, for example in a suitcase.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a collapsible athletic shoe comprising an athletic shoe having a toe end, a heel component, a sole area, and a foot portion with an inner cavity adapted to receive a user's foot, the foot portion can move between an extended position wherein a user can slide his/her foot into the inner cavity of the foot portion and a collapsed position wherein a top area of the foot portion is pushed toward the sole area of the athletic shoe; a first strap extending out of a first side of the sole area of the athletic shoe and a second strap extending out of a second side of the sole area of the athletic shoe, wherein the first strap and the second strap function to secure the foot portion of the athletic shoe in the collapsed position by pulling the first strap aver the top area of the foot portion then pulling the second strap over the first strap, the first strap and the second strap can be temporarily secured together via a first attachment means; and a heel strap having a fixed end disposed on the heel portion of the athletic shoe and a free end, a second attachment means is disposed on the free end, the heel strap functions to further secure the foot portion of the athletic shoe in the collapsed position by pushing down the heel portion of the athletic shoe and attaching the heel strap to the first strap or the second strap via the second attachment means, wherein the heel strap can be secured in a storage position by attaching the free end of the heel strap to the heel end of the athletic shoe via second attachment means.

In some embodiments, the first strap and the second strap are part of a single elongated strap that spans a width of the sole area of the athletic shoe, the first strap extends out of a first sole slot disposed in the first side of the sole area and the second strap extends out of a second sole slot disposed in the second side of the sole area. In some embodiments, the first strap or the second strap is removably attached to the athletic shoe. In some embodiments, the first attachment means is a tie mechanism, a snap mechanism, a button mechanism, a hook-and-loop fastener mechanism, or a combination thereof. In some embodiments, the second attachment means is a tie mechanism, a snap mechanism, a button mechanism, a hook-and-loop fastener mechanism, or a combination thereof.

The present invention also features collapsible athletic shoe comprising an athletic shoe having a toe end, a heel component, a sole area, and a foot portion with an inner cavity adapted to receive a user's foot, the foot portion can move between an extended position wherein a user can slide his/her foot into the inner cavity of the foot portion and a collapsed position wherein a top area of the foot portion is pushed toward the sole area of the athletic shoe; a short strap extending out of a first side of the sole area of the athletic shoe and a long strap extending out of a second side of the sole area of the athletic shoe, the short strap and the long strap each have a first end fixedly attached to the athletic shoe and a free end, wherein an eyelet component with a slot is disposed on the free end of the short strap, the slot is adapted to receive the free end of the long strap, wherein the eyelet component with the slot allows the foot portion of the athletic shoe to be secured in the collapsed position via a cinching mechanism and a third attachment means; and a heel strap having a fixed end disposed on the heel portion of the athletic shoe and a free end, a second attachment means is disposed on the free end, the heel strap functions to further secure the foot portion of the athletic shoe in the collapsed position by pushing down the heel portion of the athletic shoe and attaching the heel strap to the short strap or the long strap via the second attachment means, wherein the heel strap can be secured in a storage position by attaching the free end of the heel strap to the heel end of the athletic shoe via second attachment means.

In some embodiments, the short strap and the long strap are part of a single elongated strap that spans a width of the sole area of the athletic shoe, the short strap extends out of a first sole slot disposed in the first side of the sole area and the long strap extends out of a second sole slot disposed in the second side of the sole area. In some embodiments, the short strap or the long strap is removably attached to the athletic shoe. In some embodiments, the third attachment means is a tie mechanism, a snap mechanism, a button mechanism, a hook-and-loop fastener mechanism, or a combination thereof. In some embodiments, the second attachment means is a tie mechanism, a snap mechanism, a button mechanism, a hook-and-loop fastener mechanism, or a combination thereof.

DESCRIPTION OF PREFERRED EMBODIMENTS

Figure 1:
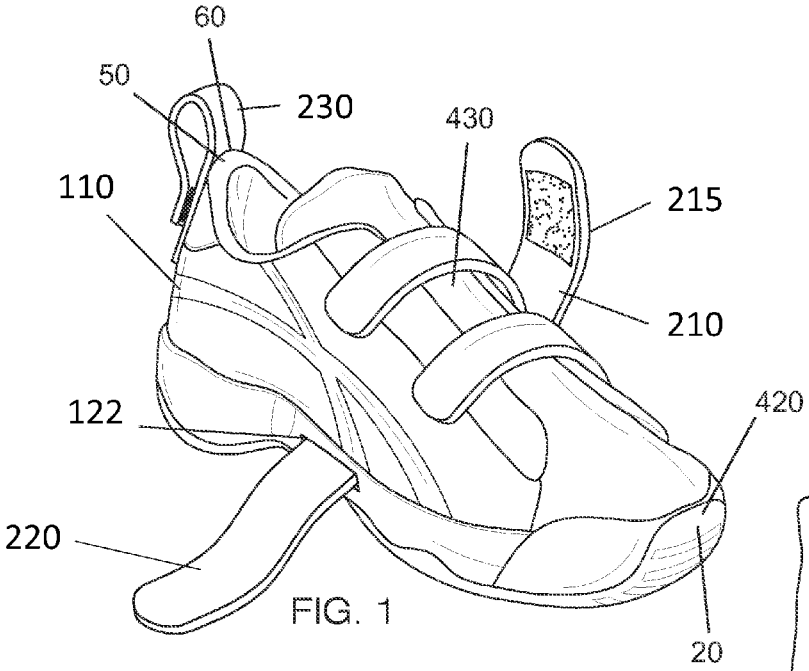
FIG. 1 is a perspective view of an embodiment of the collapsible athletic shoe of the present invention.

Referring now to FIGS. 1-6, the present invention features a collapsible athletic shoe 100. The collapsible athletic shoe 100 comprises an athletic shoe 110, which resembles a standard athletic shoe well known to one of ordinary skill in the art. For example, the athletic shoe 110 has a toe end, a heel component, and a foot component with an inner cavity adapted to receive a user's foot.

The collapsible athletic shoe 100 further comprises a main strap system. In some embodiments, the main strap system comprises a first strap 210 disposed on a first side edge of the athletic shoe 110 and a second strap 220 disposed on a second side edge of the athletic shoe 110. In some embodiments, the main strap system comprises a single elongated strap that spans the width of the bottom area of the foot component (e.g., the sole) of the athletic shoe 110. The single elongated strap may be divided into a first portion (e.g., a first strap 210) that extends out of a first sole slot 121 disposed in the first side of the sole and a second portion (e.g., a second strap 220) that extends out of a second sole slot 122 disposed in the second side of the sole. In some embodiments, the first strap 210 and/or second strap 220 are removably attached to the athletic shoe 110.

The foot portion of the athletic shoe 110 can move between an extended position (e.g., see FIG. 1) wherein a user can slide his/her foot into the inner cavity of the foot portion and a collapsed position wherein the top area of the foot portion is pushed toward the bottom area of the foot portion (e.g., the sole), which can eliminate all or a portion of the inner cavity of the foot portion.

Figure 2:
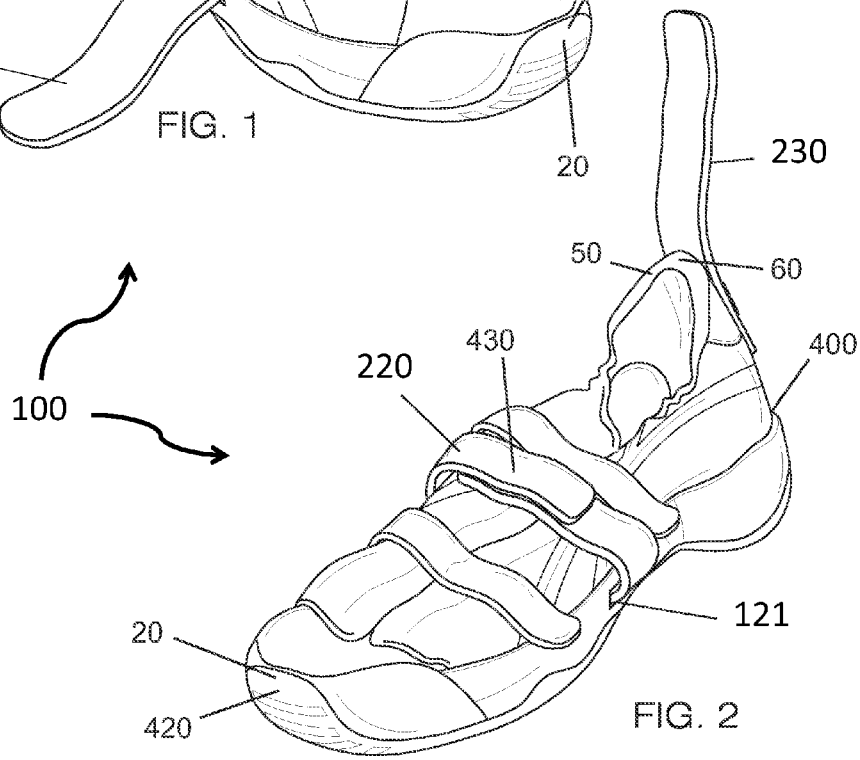
FIG. 2 is a perspective view of the collapsible athletic shoe of FIG. 1, wherein the foot portion of the athletic shoe is collapsed.
Figure 3:
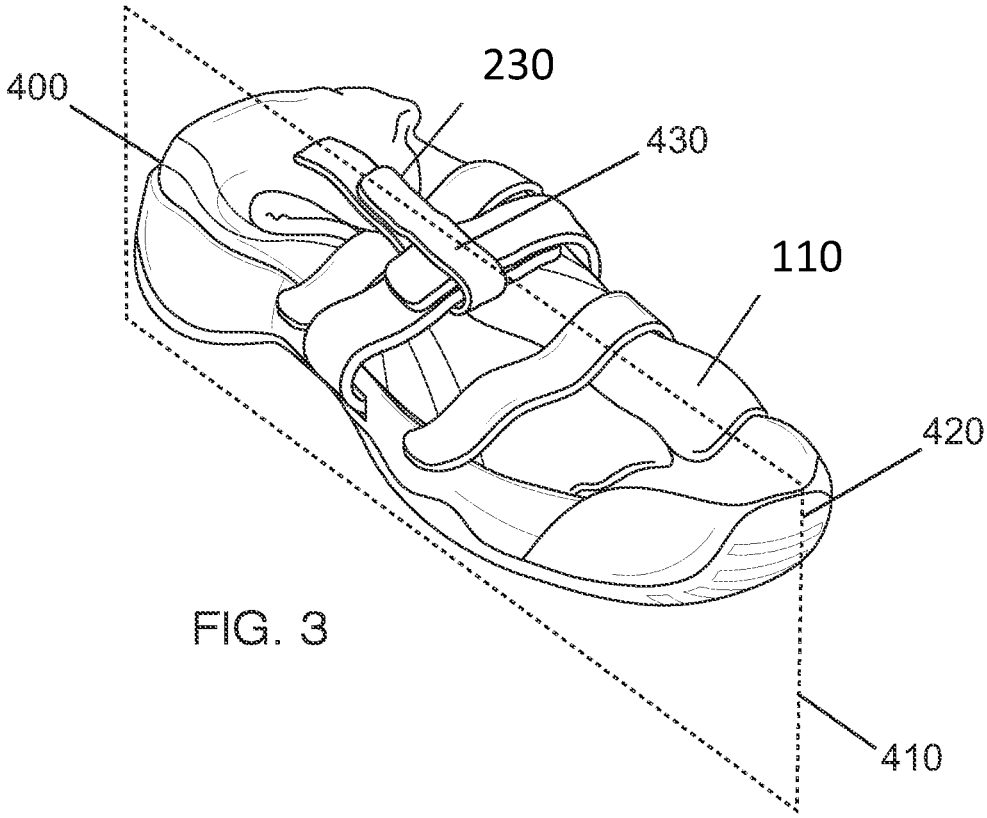
FIG. 3 is a perspective view of the collapsible athletic shoe of FIG. 2, wherein the heel portion of the athletic shoe is collapsed.

The foot portion of the athletic shoe 110 can be secured in the collapsed position via the first strap 210 and the second strap 220 (see FIG. 2). For example, a user can push downwardly on the top area of the foot portion of the athletic shoe 110 and pull the first strap over the top area of the foot portion of the athletic shoe 110. The user can then pull the second strap 220 over the foot portion and over the first strap 210. In some embodiments, the straps can be secured together via a first attachment means 215. The first attachment means 215 may include but is not limited to a tie mechanism, a snap mechanism, a button mechanism, a hook-and-loop fastener mechanism, the like, or a combination thereof.

In some embodiments, a heel strap 230 is disposed on and extends from a top rim 50 of an opening adapted for insertion of a foot of the heel portion 400 of the athletic shoe 110. In some embodiments, the heel strap 120 extends from a most posterior end 60 of the heel portion 400 of the athletic shoe 110. In some embodiments, the most posterior end 60 is disposed on a midline 70 of the heel portion 400 of the athletic shoe 110 (see FIG. 2, FIG. 3). The foot portion of the athletic shoe 110 may be further secured in the collapsed position via the heel strap 230 (e.g., in addition to the first strap 210 and the second strap 220). For example, a user can push down the heel portion 400 of the athletic shoe 110 and attach the heel strap to the first strap 210 and/or second strap 220 (see FIG. 3) via a second attachment means. The second attachment means may include but is not limited to a tie mechanism, a snap mechanism, a button mechanism, a hook-and-loop fastener mechanism, the like, or a combination thereof.

Figure 4:
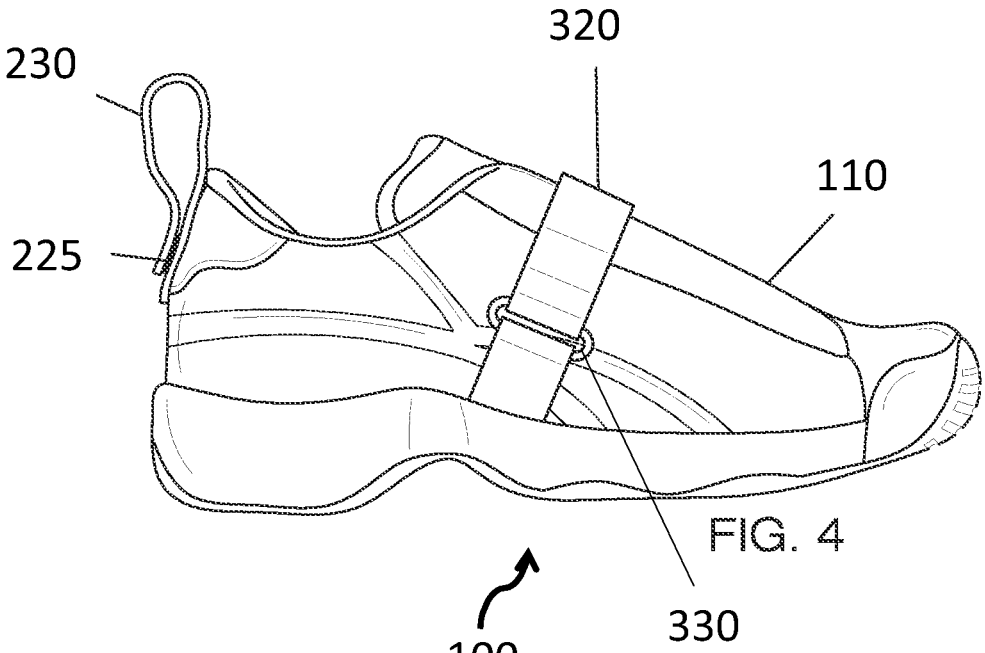
FIG. 4 is a side view of an alternative embodiment of the collapsible athletic shoe of the present invention.
Figure 5:
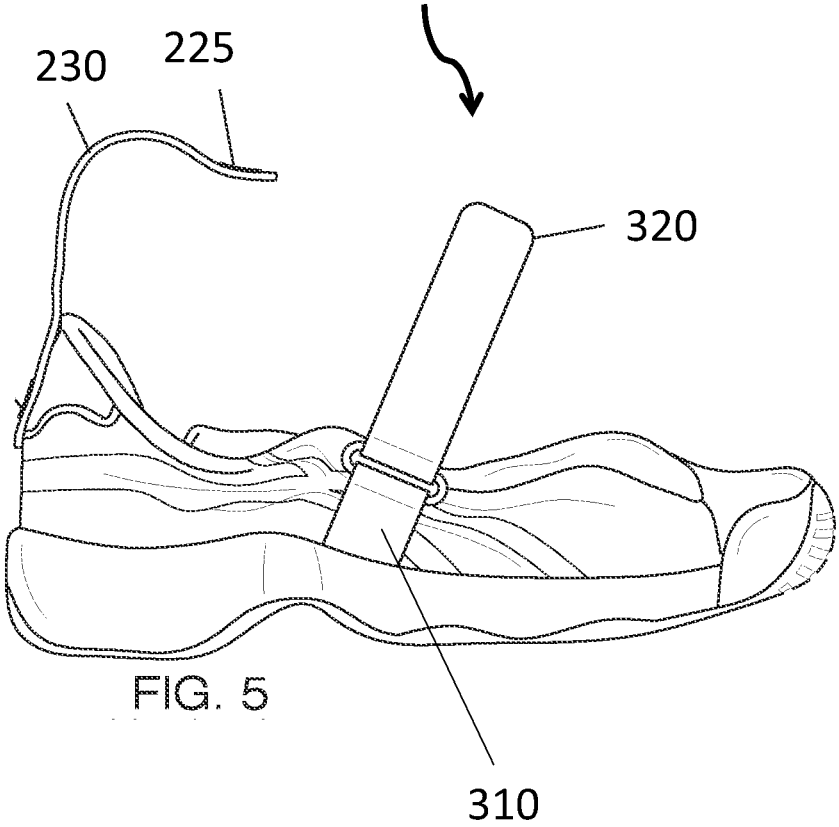
FIG. 5 is a side view of the collapsible athletic shoe of FIG. 4, wherein the foot portion of the athletic shoe is collapsed.

As shown in FIG. 4, in some embodiments, the heel strap 230 can be secured in a storage position via the second attachment means 225. For example, in addition to the end of the heel strap 230 that is fixedly attached to the top rim 50 of the opening adapted for insertion of a foot of the heel portion 400 of the athletic shoe 110 (e.g., the first end of the heel strap 230), the free end of the heel strap 230 (e.g., the second end of the heel strap 230) may be attachable to the heel portion 400 of the athletic shoe 110. FIG. 4 shows the heel strap 230 being bent away from the first strap 210 and second strap 220 and the second end of the heel strap 230 attached to the first end of the heel strap 230 via the second attachment means 225. In some embodiments, the entire heel strap 230 lies only on a vertical plane, Plane A 410, longitudinally disposed across the athletic shoe 110 on a midline 70 from a most anterior tip 20 of the toe end 420 to the most posterior end 60 of the heel portion 400. In some embodiments, the entire heel strap 230 lies only on a midline 70 longitudinally disposed across the athletic shoe 110 from the most anterior tip 20 of the toe end 420 to the most posterior tip 60 of the heel portion 400. In some embodiments, the first strap 210, the second strap 220, and the heel strap 230 attachably intersect at a middle point 430 of the top area of the foot portion of the athletic shoe 110. In some embodiments, the second attachment means 225 attachably connects to the heel portion 400 completing a loop.

Referring to FIGS. 4-7, in some embodiments, the main strap system comprises a short strap 310 disposed on the first side edge of the athletic shoe 110 and a long strap 320 disposed on a second side edge of the athletic shoe 110. The short strap 310 and the long strap 320 each have an end fixedly attached to the athletic shoe 110 (e.g., a first end) and a free end (e.g., a second end). Disposed on the second end of the short strap 310 is an eyelet component 330 with a slot adapted to receive the second end of the long strap 320. The eyelet component 330 allows the foot portion of the athletic shoe 110 to be secured in the collapsed position via a cinching mechanism. Cinching mechanisms and cinch straps are well known to one of ordinary skill in the art.

The short strap 310 and long strap 320 can be secured via a third attachment means. The third attachment means may include but is not limited to a tie mechanism, a snap mechanism, a button mechanism, a hook-and-loop fastener mechanism, the like, or a combination thereof.

Figure 6:
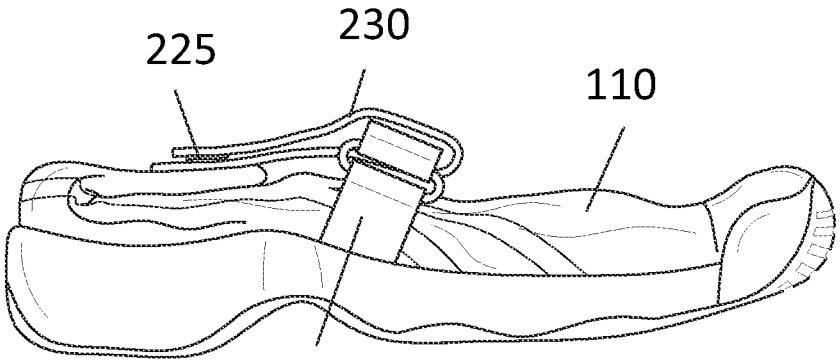
FIG. 6 is a side view of the collapsible athletic shoe of FIG. 5, wherein the heel portion of the athletic shoe is collapsed.
Figure 7:
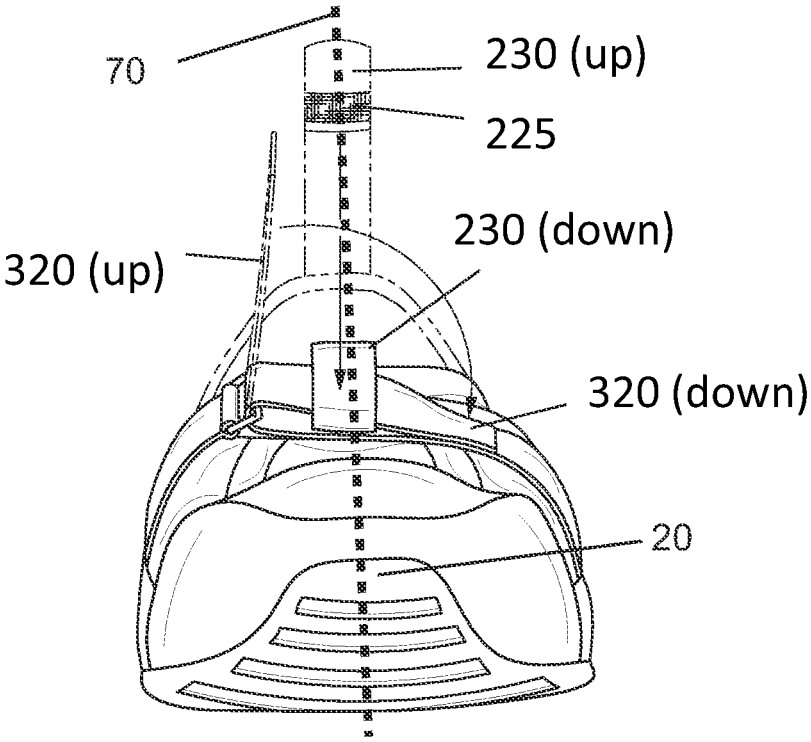
FIG. 7 is a front view of the collapsible athletic shoe of FIG. 6.

The heel strap 230 may also be used in combination with the short strap 310 and long strap 320 (see FIG. 6, FIG. 7).

The following the disclosures of the following U.S. Patents are incorporated in their entirety by reference herein: U.S. Pat. No. 7,168,190; U.S. Pat. Application No. 2002/0129519; U.S. Pat. Application No. 2004/0128863; U.S. Pat. No. 7,010,872; U.S. Pat. No. 6,298,583; U.S. Pat. No. 5,956,868; U.S. Pat. No. 6,477,793; U.S. Pat. No. 5,086,576.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A collapsible athletic shoe comprising:

(a) an athletic shoe having a toe end, a heel portion, a sole area, and a foot portion with an inner cavity adapted to receive a user's foot, the foot portion can move between an extended position wherein a user can slide his/her foot into the inner cavity of the foot portion and a collapsed position wherein a top area of the foot portion is pushed toward the sole area of the athletic shoe;

(b) a first strap extending out of a first side of the sole area of the athletic shoe and a second strap extending out of a second side of the sole area of the athletic shoe, wherein the first strap and the second strap function to secure the foot portion of the athletic shoe in the collapsed position by pulling the first strap over the top area of the foot portion then pulling the second strap over the first strap, the first strap and the second strap can be temporarily secured together via a first attachment means; and (c) a heel strap having a fixed end extending from a top rim of an opening adapted for insertion of a foot of the heel portion of the athletic shoe, wherein the heel strap extends from a most posterior end of the heel portion of the athletic shoe, wherein the most posterior end is disposed on a midline of the athletic shoe, wherein the heel strap comprises a free end, wherein a second attachment means is disposed on the free end, wherein the heel strap is designed to further secure the foot portion of the athletic shoe in the collapsed position by pushing down the heel portion of the athletic shoe and attaching the heel strap to the first strap or the second strap via looping the heel strap around the first strap or the second strap then attaching the free end of the heel strap to the heel portion of the athletic shoe via second attachment means, wherein the entire heel strap lies only on a vertical plane (410) longitudinally disposed across the athletic shoe on said midline from a most anterior tip of the toe end to the most posterior end of the heel portion, wherein the entire heel strap lies only on a midline longitudinally disposed across the athletic shoe from the most anterior tip of the toe end to the most posterior tip of the heel portion;

wherein the first strap, the second strap, and the heel strap intersect with each other at a middle point of the top area of the foot portion of the athletic shoe when they are attached together, wherein the second attachment means attachably connects to the heel portion completing a loop.

2. The collapsible athletic shoe of claim 1, wherein the first attachment means is a tie mechanism, a snap mechanism, a button mechanism, a hook-and-loop fastener mechanism, or a combination thereof.

3. The collapsible athletic shoe of claim 1, wherein the second attachment means is a tie mechanism, a snap mechanism, a button mechanism, a hook-and-loop fastener mechanism, or a combination thereof.

* * * * *